US005451054A

United States Patent [19]

Orenstein

[11] Patent Number: 5,451,054

[45] Date of Patent: Sep. 19, 1995

[54] POKER TOURNAMENT

[75] Inventor: Henry Orenstein, Verona, N.J.

[73] Assignee: Toy Builders, Caldwell, N.J.

[21] Appl. No.: 237,061

[22] Filed: May 3, 1994

[51] Int. Cl.[6] ..... A63F 1/06

[52] U.S. Cl. ..... 273/148 R; 273/309

[58] Field of Search ..... 273/148 R, 148 B, 274, 273/309, 439, 292, 304; 434/129

[56] References Cited

U.S. PATENT DOCUMENTS 5,110,134 5/1992 Laughlin et al. ..... 273/309
5,112,060 5/1992 Jones ..... 273/148 R X
5,312,104 5/1994 Miller ..... 273/309 X
5,362,053 11/1994 Miller ..... 273/148 R
5,397,133 3/1995 Pengias ..... 273/439

FOREIGN PATENT DOCUMENTS 9221413 12/1992 WIPO ..... 273/148 R

*Primary Examiner*—William E. Stoll
*Attorney, Agent, or Firm*—Brumbaugh, Graves, Donohue & Raymond

[57] ABSTRACT

A poker tournament is displayed to an audience using a tournament table having stations for receiving and scanning the image of each players down cards. The display can identify the down cards of the players to the audience without revealing the information to the other players so that the audience can fully observe the strategy of each player.

7 Claims, 3 Drawing Sheets

| PLAYER | DOWN CARDS | | COMMON CARDS | BET | HOLDING |
|---|---|---|---|---|---|
| SMITH | 2♡ | 7♣ | | 0 | 16,000 |
| MURPHY | 5◇ | 9♠ | K♠ | 0 | 8,700 |
| JONES | OUT | | 7◇ | — | BUST |
| ORENSTEIN | A♠ | J♠ | Q♠ | 5,000 | 688,000 |
| ADAMS | OUT | | 10♠ | — | 28,000 |
| KELLY | OUT | | K♣ | — | 14,000 |
| ANDERSON | K◇ | K♡ | | 10,000 | 168,000 |
| NEWMAN | Q◇ | Q♠ | | 15,000 | 22,000 |

42

FIG. 7

POKER TOURNAMENT

BACKGROUND OF THE INVENTION

The present invention relates to exhibition of a card tournament, particularly a poker tournament. Heretofore, exhibition of a card tournament, although of potential interest to an audience, particularly where the strategy and play of top players can be observed, is substantially limited because the audience cannot observe the "down cards" of the players as play progresses and therefore cannot observe player strategy. In addition, the audience cannot easily keep track of the number of chips retained by each player, and accordingly cannot easily keep track of the flow of the game.

It is therefore an object of the present invention to provide a method and apparatus for exhibiting a card tournament in a manner that the audience, but not the players, can observe the unseen cards of the players and accurately keep track of the flow of the game.

SUMMARY OF THE INVENTION

In accordance with the invention there is provided an apparatus for real time exhibition of a card tournament to an audience. The apparatus includes a playing table having a plurality of playing positions and a card receiving station at each of the playing positions, each station having a window and card scanning apparatus for electronically identifying cards placed face down at the station. There is also provided an image display means for exhibiting the identification of the cards to the audience.

In a one arrangement the card scanning apparatus comprises a television camera and the image display means comprises means for generating a composite television display from a plurality of said television cameras.

In another arrangement the scanning apparatus comprises character recognition apparatus and the image display means comprises a computer generated display.

The playing table may further include a chip receptacle at each of the playing positions, wherein each receptacle includes means for providing electronic signals representative of the quantity of chips contained therein, and wherein said image display means includes means for displaying the value of the chips at each receptacle.

In accordance with the invention there is provided a method for exhibiting a card tournament, comprising the steps of detecting and displaying to an audience the face up cards of the players and the betting action; detecting by optical means the face down cards of each player and displaying the value thereof to the audience; detecting the value of chips possessed by each player and displaying the value thereof to the audience; and isolating the players from the display of the face down cards.

For a better understanding of the present invention, together with other and further objects thereof, reference is made to the following description, taken in conjunction with the accompanying drawings, and its scope will be pointed out in the appended claims.

BRIEF DESCRIPTION OF THE DRAWINGS

FIG. 7 is an illustration of a display generated by the FIG. 5 apparatus.

DESCRIPTION OF THE INVENTION

The present invention relates to apparatus and a method that enables exhibition of an on-going poker tournament that enables the audience to observe the hidden "down" cards of each player, without disturbing the play and without revealing the cards to other players. In order to achieve this capability, it is assumed that play takes place in a closed room, and that measures are taken to prevent the players from receiving messages from outside the room, so that they do not receive messages about the other player's cards.

The apparatus of the invention includes a specially designed playing table 10, which enables the hidden cards of each player to be remotely viewed and/identified. The cards to be used are standard playing cards, and the game can be any version of a known game, which is suitable for the number of participants. For a tournament involving a larger number of players, a suitable poker game is one in which the players each are dealt a number of "down" cards and the "up" cards are common to all players. In the illustrated example, each player is dealt two down cards, and five common "up" cards are dealt. The sequence of dealing and the sequence of wagering can be appropriately selected for each tournament and are not of concern with respect to the invention.

Figure 1:
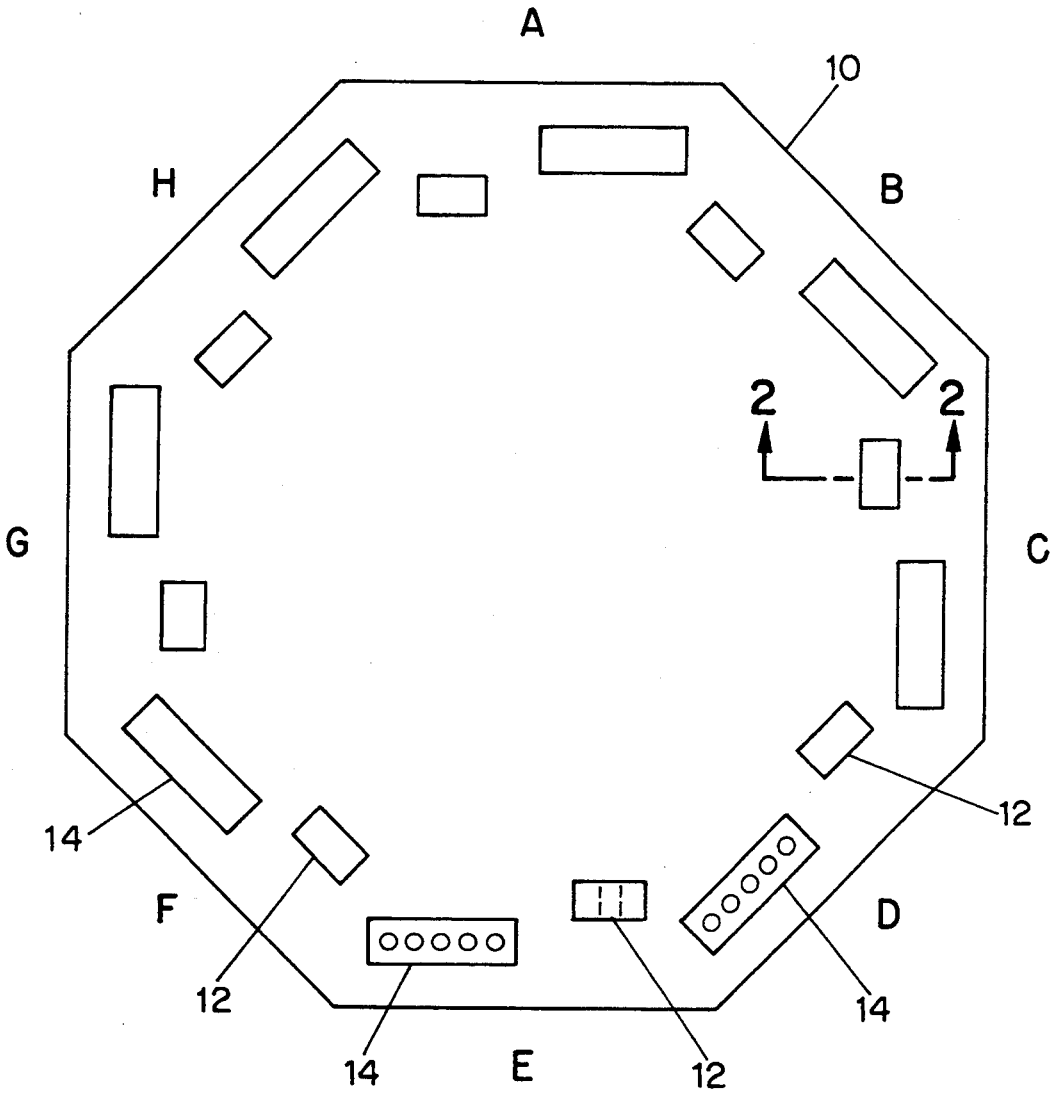
FIG. 1 is an overhead view of a card table incorporating apparatus in accordance with the present invention.
Figure 2:
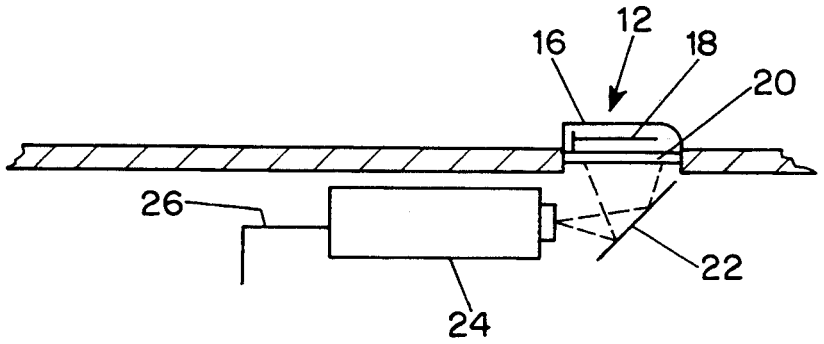
FIG. 2 is a cross-sectional view of the table of FIG. 1.
Figure 3:
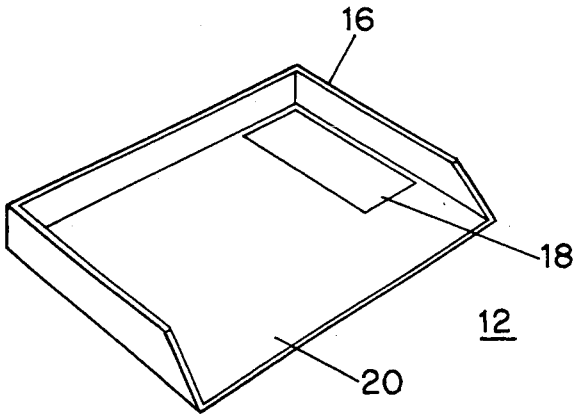
FIG. 3 is an enlarged perspective view of one of the card receiving stations of the FIG. 1 table.

The table 10 of FIG. 1 is configured for eight players, but a greater or lesser number can be accommodated by re-configuring the table. The table includes positions A to H at which the players are to be seated. Each position is provided with a card receiving station 12 and a chip receptacle 14. A cross sectional view of table 10 showing one of the card receiving stations 12 is shown in FIG. 2, and a perspective enlarged view thereof is shown in FIG. 3.

Each station 12 includes card positioning walls 16, which are adjacent a window 20 formed in the surface of the table. Below the table there is provided a card scanning apparatus 24, which may include an image deflecting mirror 22 and appropriate illumination apparatus. In the illustrated arrangement the card scanning apparatus is a closed circuit television camera 24 oriented to view the face of a card 18 positioned in the card station 12. Station 12 can be configured to receive and position as many cards as are to be dealt down to each player, and the scanning apparatus can be focussed to scan the entire card or only a portion of the card for purposes of subsequent display or identification.

Figure 5:
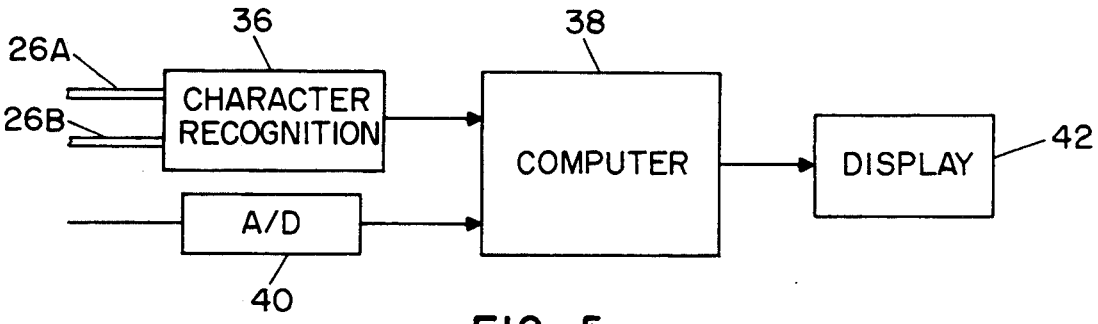
FIG. 5 is a block diagram of a display generating apparatus useful in the present invention.

In one arrangement according to the invention, as illustrated in FIG. 5, the scanned image of the playing card, or a portion thereof, such as the marked corner is provided as a video signal to a character recognition device 36 of the type used to recognize characters on a written page. The recognition device can compare a portion of the printed image on the playing cards to standard images and thereby identify the card in the card receiving station. The provision of sidewalls 16 can aide in the location of card 18, and thereby place the card image in a location which is standardized to thereby aide in the recognition process.

Figure 6:
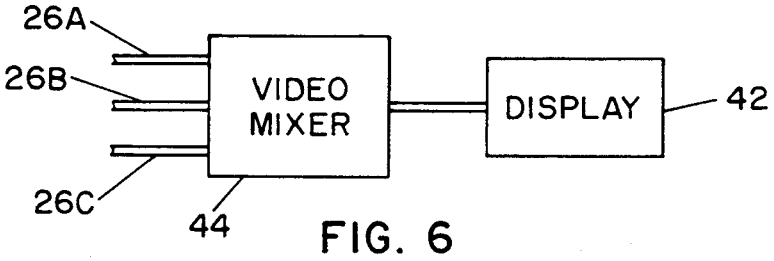
FIG. 6 is a block diagram of an alternate display generating apparatus.

In one alternate arrangement the image of the cards can be visually displayed to a tournament director who can also provide the recognition thereof as a keyed input to computer 38. In still another arrangement illustrated in FIG. 6, the video signals from a plurality of scanning devices are provided on cables 26A, 26B, 26C, etc. to a video mixer device 44, which captures a portion of each video signal to generate a composite signal with the images of each players "down" cards to the display 42.

Figure 4:
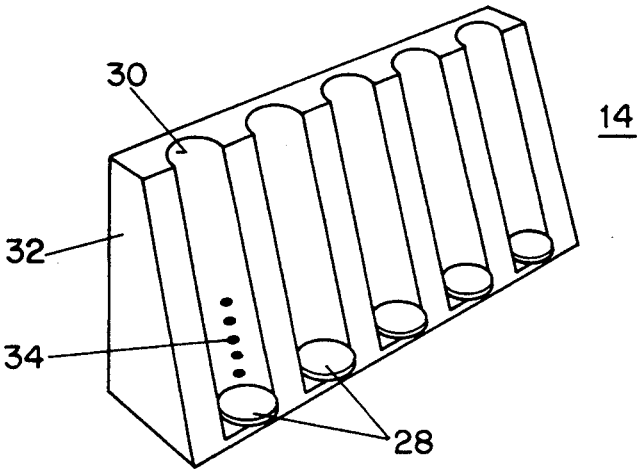
FIG. 4 is an enlarged perspective view of one of the chip receptacles of the FIG. 1 table.

In addition to display of the "down" cards, the system may also be arranged to capture and display information regarding the relative standing of each player. In connection with a poker or other card game involving stakes, each player can be required to place his or her chips on a chip receptacle 14, which includes an arrangement for determining the number of chips retained by each player. In particular, as shown in FIG. 4, each receptacle 14 includes a plurality of chip receiving columns 30 formed as semicircular grooves. At the base of each column 30 a sensor 28 is provided for detecting the weight, and therefore the value of the chips contained therein. The weight proportional output signal of detectors 28 is provided to an A to D converter 40, which provides a digital signal to computer 38 indicating the number of chips in the column. Since chips of different denomination would be placed in different columns, computer 38 can ascertain the value of chips possessed by each player and display that value for the audience as a measure of that player's progress.

The present invention can be used to generate a wide variety of tournament displays along with commentator narration of a card tournament and superimposed or intermittent video of the card playing action and players vocalizations. One of the possible displays of card and wagering status for a poker tournament involving 8 players is shown in FIG. 7. This display includes the players' names, "down" cards, common cards, the wagering status and the holdings of each player. The information can be derived from the card scanning device 24, the chip receptacle 14 and manually keyed by an observer. By having this information available to the audience the exhibition of the tournament by cable, closed circuit or regular television can be greatly enhanced for the audience.

It should be evident that the same principles apply to exhibition of other card tournaments, such as bridge tournaments, blackjack tournaments and the like.

While there has been described what is believed to be a preferred embodiment of the invention, those skilled in the art will recognize that modification may be made thereto without departing from the spirit of the invention and it is intended to claim all such modifications as fall within the scope of the invention.

I claim:

1. Apparatus for real time exhibition of a card tournament to an audience, comprising:

a playing table having a plurality of playing positions;

a card receiving station at each of said playing positions, each station having a window and card scanning apparatus for electronically identifying cards placed face down at said station; and image display means for exhibiting the identification of said cards to an audience.

2. Apparatus as specified in claim 1 wherein said card scanning apparatus comprises television-cameras.

3. Apparatus as specified in claim 2 wherein said image display means comprises means for generating a composite television display using the image signals from a plurality of said television cameras.

4. Apparatus as specified in claim 1 wherein said card scanning apparatus comprises character recognition apparatus.

5. Apparatus as specified in claim 4 wherein said image display means comprises a computer generated display.

6. Apparatus as specified in claim 1 wherein there is further provided a chip receptacle at each of said playing positions, and wherein said receptacles include means for providing signals representative of the quantity of chips contained therein, and wherein said image display means includes means for displaying the amount of chips at each receptacle.

7. A method for exhibiting a card tournament, comprising the steps of:

detecting and displaying to an audience the face up cards of the players and the betting action:

detecting by electronic optical means the face down cards of each player and displaying the value thereof to an audience;

detecting the value of chips possessed by each player and displaying the value thereof to an audience; and isolating said players from display of said face down cards.

* * * * *